United States Patent [19]

Freudenreich et al.

[11] Patent Number: 4,682,274

[45] Date of Patent: Jul. 21, 1987

[54] AUTOMOTIVE HEADLIGHT

[75] Inventors: Erwin Freudenreich; Horst Flerlage, both of Lippstadt; Karlernst Sewing, Lippstadt-Hörste, all of Fed. Rep. of Germany

[73] Assignee: Hella KG Hueck & Co., Lippstadt, Fed. Rep. of Germany

[21] Appl. No.: 903,463

[22] Filed: Sep. 3, 1986

[30] Foreign Application Priority Data

Jan. 25, 1986 [DE] Fed. Rep. of Germany ..... 3602234

[51] Int. Cl.[4] ..... H01R 33/46; F21M 3/00

[52] U.S. Cl. ..... 362/61; 362/226; 362/267

[58] Field of Search ..... 362/61, 226, 267, 378, 362/433, 434, 435, 437, 443; 313/318

[56] References Cited

U.S. PATENT DOCUMENTS

| | | | |
|---|---|---|---|
| 2,992,323 | 7/1961 | Fletcher | 362/226 |
| 4,100,448 | 7/1978 | Chipner | 362/267 |
| 4,219,870 | 8/1980 | Haraden et al. | 362/226 |
| 4,339,790 | 7/1982 | Hanson et al. | 362/267 |
| 4,344,120 | 8/1982 | Bradley | 362/267 |
| 4,403,276 | 9/1983 | Blaisdell | 362/226 |
| 4,513,356 | 4/1985 | Mikola | 362/267 |
| 4,590,542 | 5/1986 | Schauwecker et al. | 362/61 |

*Primary Examiner*—James C. Yeung
*Attorney, Agent, or Firm*—Max Fogiel

[57] ABSTRACT

An automotive headlight with a bowl-shaped plastic reflector. The reflector has at its apex an opening surrounded at the rear of the reflector by a sheet-metal retaining ring. The ring accommodates an incandescent lamp. The lamp is inserted into openings in the reflector with its securing tabs bent back toward the reflector and is secured to the reflector by barbs on the securing tabs that engage the edges of the holes. To improve the headlight to the extent that the openings in the reflector that accommodate the securing tabs are large enough not to shorten the life of the tool and do not need to be produced with such a precise tolerance, while still ensuring that the retaining ring will fit the reflector reliably and snugly, the securing tabs are bent into a U and the openings in the reflector that accommodate the tabs are quadrilateral and approximately as high and as wide as the tabs.

11 Claims, 6 Drawing Figures

FIG. 3
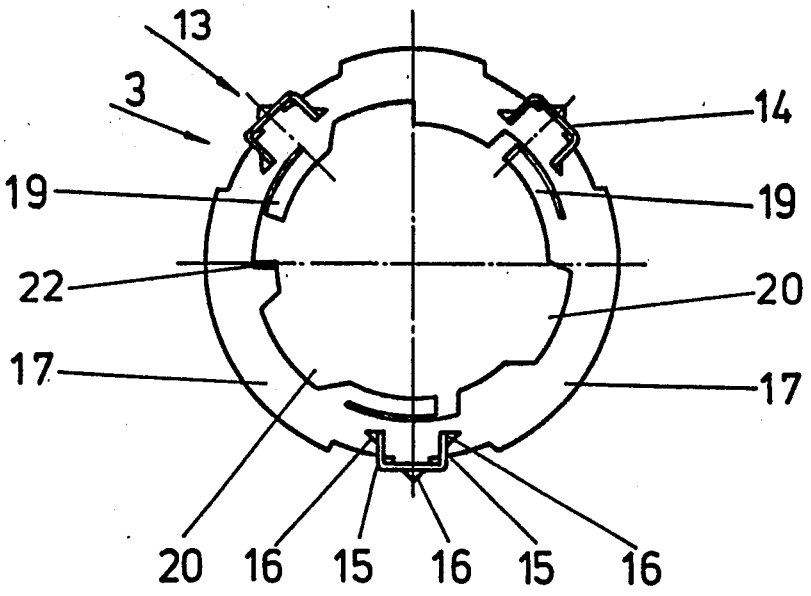
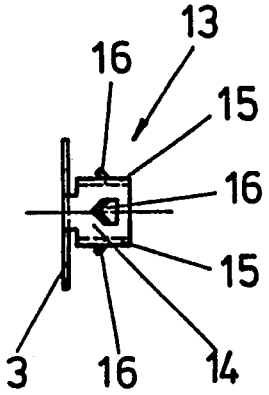
FIG. 4
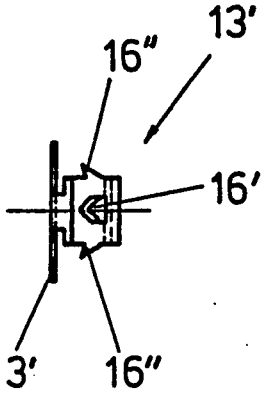
FIG. 6
FIG. 5
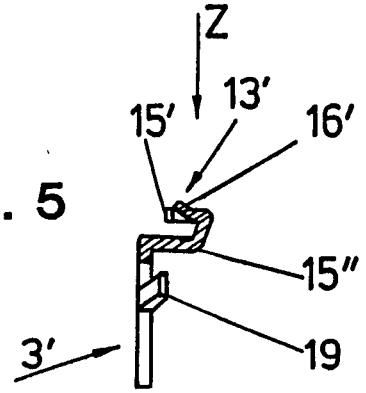

AUTOMOTIVE HEADLIGHT

BACKGROUND OF THE INVENTION

The present invention relates to an automotive headlight with a bowl-shaped plastic reflector that has at its apex an opening surrounded at the rear of the reflector by a sheet-metal retaining ring that accommodates an incandescent lamp, that is inserted into openings in the reflector with its securing tabs bent back toward the reflector, and that is secured to the reflector by barbs on the securing tabs that engage the edges of the holes.

The opening in the apex of the plastic reflector in an automotive headlight of this type, known from Italian Pat. No. 864,607, is surrounded by a collar. Shaped onto the outside of the collar are diametrically opposed elevations with slit-like openings that accommodate the bent-back securing tabs on the retaining ring that secures the lamp. Cut free and bent out from each securing tab is a barbed tongue extending in the direction opposite the one that the retaining ring is inserted in. The barbs, which engage the openings in the reflector secure the retaining ring to the reflector.

Since the dies that produce the slit-like openings in the elevations on the reflector are very thin-walled, the life of the tool is extremely short. Futhermore, the retaining ring can be mounted simply and rapidly only when the distance between the openings in the reflector and that between the securing tabs coincide with a highly precise tolerance. Again, the openings must match the width of the securing tabs with a very precise tolerance if the retaining ring that accommodates the lamp is to fit snugly.

Another automotive headlight is known form German GM Pat. No. 7,321,153. Its securing tabs are bent back in the direction that the retaining ring is inserted in and have barbs that are cut free at the lateral edges and taper conically down to their free end. The securing tabs are again, as in the aforesaid automotive headlight, inserted into slit-like openings in the reflector. These openings must match the width of the securing tabs very precisely.

SUMMARY OF THE INVENTION

The object of the present invention is to improve an automotive headlight of the aforesaid generic type to the extent that the openings in the reflector that accommodate the securing tabs are large enough not to shorten the life of the tool and do not need to be produced with such a precise tolerance, while still ensuring that the retaining ring will fit the reflector reliably and snugly.

This object is attained in accordance with the invention in that the securing tabs are bent into a U and in that the openings in the reflector that accommodate the tabs are quadrilateral and approximately as high and as wide as the tabs. This solution, although simple and cost-effective, will ensure that the retaining ring will fit the reflector reliably and snugly even with only one barb on each securing tab if the legs of the U-shaped tabs are spring-loaded against opposite areas of the opening and if the barb engages one of the other two areas.

The lines that the U-shaped securing tabs are bent along in one practical embodiment of the invention parallel the direction that the retaining ring is inserted in. This design does not require as large a sheet-metal blank for the retaining ring. It is practical in this embodiment for the barbs to consist of at least one tongue that is cut free from the web and/or from the legs of the U that the securing tabs are bent into and that is bent towards the sides of the opening in the direction opposite the one that the retaining ring is inserted in. When the legs are relatively short, it is practical for at least one barb that extends in a direction opposite the one that the retaining ring is inserted in to be cut free from the faces of the securing tabs.

The lines that the U-shaped securing tabs are bent along in another practical embodiment of the invention are at an angle to the direction that the retaining ring is inserted in. It is practical in this embodiment for the barb to consist of at least one tongue that is cut free from the legs of the U that the securing tabs are bent into and that is bent towards the sides of the opening in the direction opposite the one that the retaining ring is inserted in and for at least one barb that extends in the direction opposite the one that the retaining ring is inserted in to be cut free from the lateral edges of the legs of the U-shaped securing tabs. If the barbs taper conically down to their free end, the retaining ring will fit the reflector reliably and snugly.

It is also practical for the securing tabs to have mounting bevels on the free end that extends toward the reflector. This makes it very rapid and easy to thread the securing tabs on the retaining ring into the openings in the refelector.

It is also practical for coaxial or tangential arms that are spring loaded against a flange on the lamp and between the retaining ring and the reflector to be cut free from the inner edge of the retaining ring. The spring force on the arms opposes the barbs on the securing tabs adjacent to the edges of the hole.

If the securing tabs are distributed irregularly around the retaining ring, the ring can be mounted on the reflector only in a specific position.

Some preferred embodiments of the invention will now be described with reference to the attached drawings, wherein

BRIEF DESCRIPTION OF THE DRAWINGS

FIG. 3 is a view of the retaining ring along the direction X in FIG. 2, FIG. 4 is a view of the one of the securing tabs on the retaining ring along the direction Y in FIG. 2, FIG. 5 is a view of part of a retaining ring with a different type of securing tab, and FIG. 6 is a view of the securing tab illustrated in FIG 5 along the direction Z.

DETAILED DESCRIPTION OF THE PREFERRED EMBODIMENTS

Figure 1:
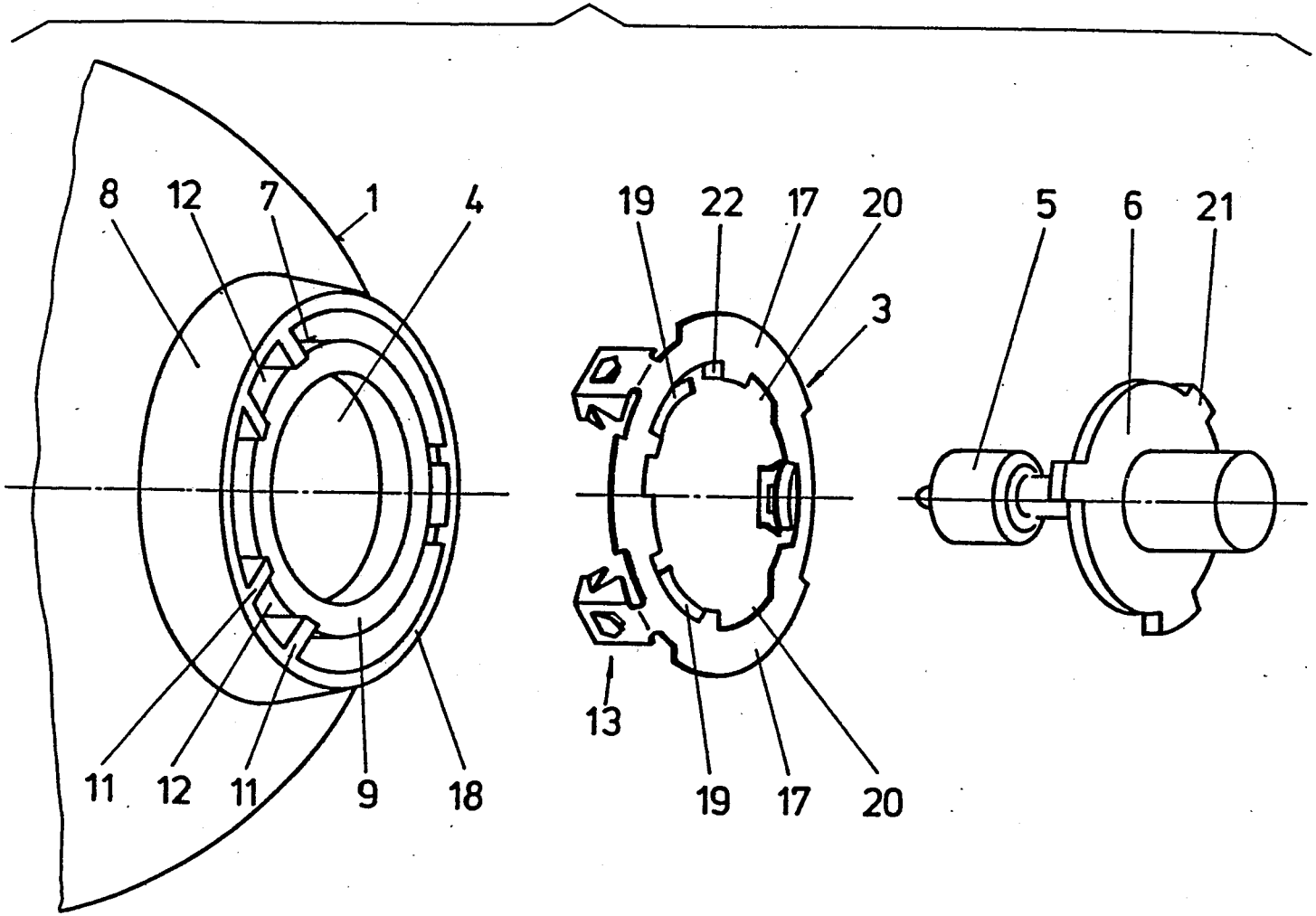
FIG. 1 is an exploded perspective view of a reflector, of a retaining ring that can be mounted on the neck of the reflector, and of an automotive-headlight incandescent lamp that can be bayonetted into the retaining ring.

An automotive headlight consists essentially of a cover glass 2 that seals off the inside of a plastic reflector 1, of a sheet-metal retaining ring 3 mounted on the rear of the reflector and surrounding an opening 4 in the apex of the reflector, and of an incandescent lamp 5 with a flange 6 around it that can be bayonetted between the retaining ring and the reflector.

The opening 4 in the apex of refelector 1 is surrounded by two collars 7 & 8. The flange 6 on lamp 5 rests against one face 9 of inner collar 7, the face toward the rear of reflector 1. Outer collar 8 extends beyond inner collar 7. Pairs of partitions 11, which are in one piece with collars 7 & 8, are positioned at three points around the groove 10 between the collars. Left between each pair of partitions 11 and each collar 7 and 8 is an opening 12. Securing tabs 13 that are bent down from retaining ring 3 toward reflector 1 can be inserted in openings 12. Securing tabs 13 are distributed irregularly around retaining ring 3. The free end of each tab 13 that extends toward reflector 1 has a mounting bevel 23.

Figure 2:
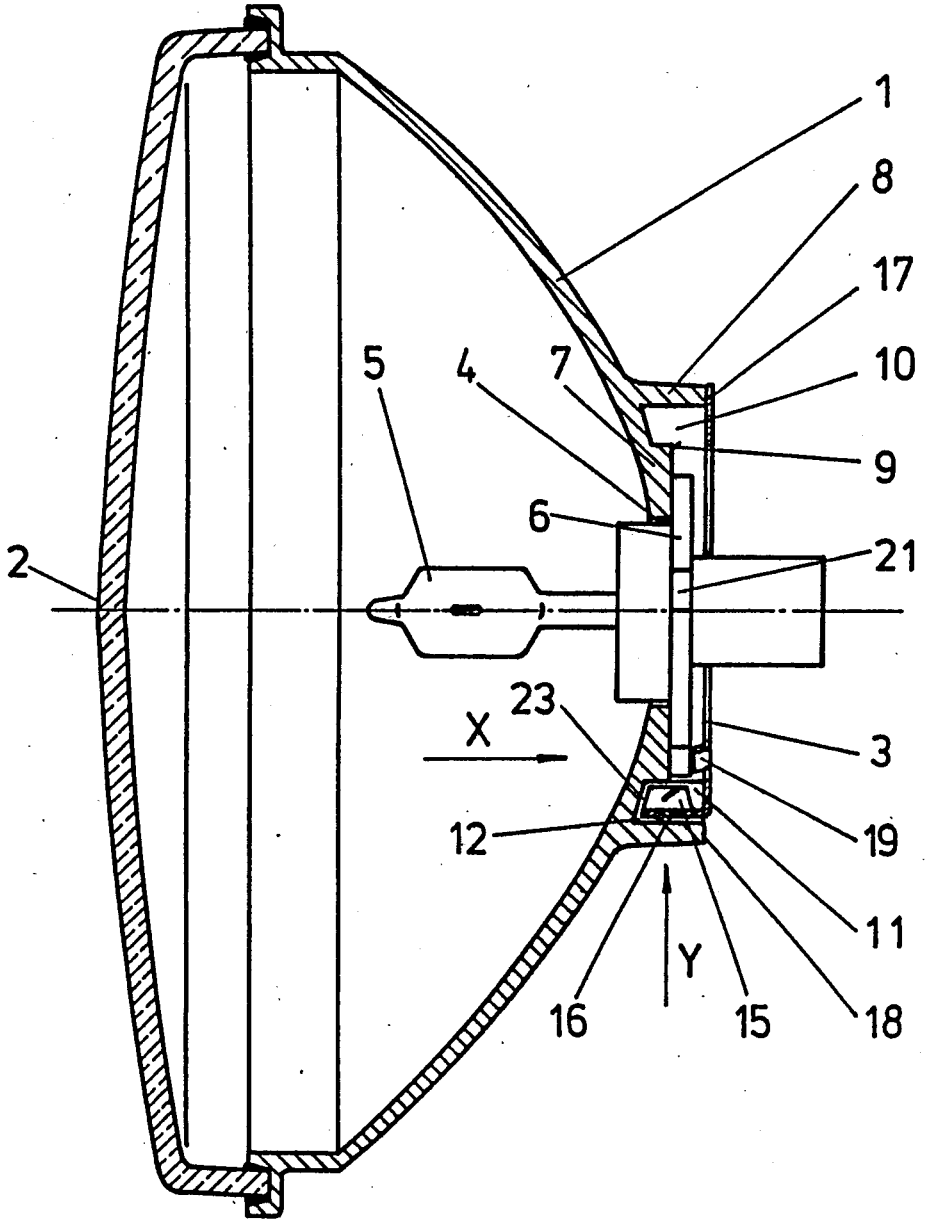
FIG. 2 is a section through the middle of the automotive headlight.

The securing tabs 13 on retaining ring 3 illustrated in FIGS. 2 through 4 are bent into a U. The lines that tabs 13 are bent along parallel the direction that the retaining ring (3) is inserted in, and their legs extend radially inward. A barb 16 in the form of a tongue is cut free from the web 14 and from the two legs 15 of each U-shaped securing tab 13, extending in the direction opposite the one that the retaining ring is inserted in and bent toward the sides of the opening 12. The barbs 16 taper conically to their free end. Once securing tabs 13 have been inserted into the openings 12 in reflector 1, barbs 16 will engage the sides of the openings and the area of the outer edge 17 of retaining ring 3 between securing tabs 13 will rest against the face 18 of outer collar 8. The areas of the retaining ring 3 on each side of a securing tab 13 will also rest against the surface of the partitions 11 between collars 7 & 8 that faces the rear of reflector 1, Coaxial arms 19 are cut free from the inner edges of retaining ring 3 in the vicinity of the three securing tabs 13 and describe an arc toward reflector 1. A recess 20 is punched out of the area of the inner edge of retaining ring 3 between each arm 19. A flap 21 projecting from the flange 6 around incandescent lamp 5 extends through each recess 20 when the lamp is mounted. Lamp 5 is then rotated in the direction that arms 19 point in until one flap 21 on flange 6 comes to rest aginst a stop 22 on retaining ring 3. The stop can be a tongue cut free from the inner edge of reflector 1 and bent toward reflector 1. When lamp 5 is in its final position, the midsection of the curved arms 19 on retaining ring 3 will be tensioned against the flaps 21 on flange 6 and will force them along with the flange against the face 9 of inner collar 7, with the face functioning as an abutment.

The securing tabs 13' that extend toward reflector 1 from the retaining ring 3' illustrated in FIGS. 5 and 6 are bent radially outward at two points at an angle to the direction that the ring is inserted in. The free leg 15' of each U-shaped tab 13' has a barb 16' that is cut free in the form of a tongue extending in the direction opposite the one that retaining ring 3' is inserted in and bent radially out of the leg. There is another barb 16'' at the lateral edge of each leg 15 and 15'' extending in the direction opposite the one that the retaining ring is inserted in.

The invention has been described herein with reference to exemplary embodiments. It will be understood, however, that it is receptable of various modifications, which will offer themselves to those skilled in the art and which are intended to be encompassed within the protection sought for the invention as set forth in the appended claims.

We claim:

1. An automotive headlight comprising: a bow-shaped plastic reflector having an apex and an opening at said apex; a sheet metal retaining ring surrounding said opening at the rear of the reflector; an incandescent lamp held by said retaining ring and inserted into said opening at said apex; securing tabs on said retaining ring, said securing tabs being bent back toward said reflector; barbs on said securing tabs for securing said retaining ring to said reflector; opening forming means on said reflector at said apex and surrounding said opening at said apex, said opening forming means forming a plurality of openings having a quadrilateral shape and being substantially as deep and wide as said tabs; said barbs engaging edges of said openings; said securing tabs being bent into a U-shape; said openings in said reflector receiving said tabs.

2. An automotive headlight as defined in claim 1, wherein said U-shaped securing tabs are bent along lines parallel to insertion direction of said retaining ring.

3. An automotive headlight as defined in claim 1, wherein said U-shaped securing tabs are bent along lines located at an angle to insertion direction of said retaining ring.

4. An automotive headlight as defined in claim 3, wherein a barb comprises at least one tongue cut free from legs of the U-shape of said securing tabs, said tongue being bent towards sides of said openings in a direction opposite to insertion direction of said retaining ring.

5. An automotive healight as defined in claim 1, wherein said barbs comprise at least one tongue cut free from the U-shape of said securing tabs, said tongue being bent towards sides of said openings in a direction opposite to insertion direction of said retaining ring.

6. An automotive headlight as defined in claim 1 wherein at least one barb extends in a direction opposite to insertion direction of said retaining ring, said on barb being cut free from faces of said securing tabs.

7. An automotive headlight as defined in claim 1 wherein at least one barb extends in a direction opposite to insertion direction of said retaining ring, said one barb being cut free from lateral edges of legs of said U-shaped securing tabs.

8. An automoive headlight as defined in claim 1, wherein said barbs taper conically down to a free end.

9. An automotive headlight as defined in claim 1, wherein said securing tabs have a free end extending toward said reflector; and mounting bevels on said free end.

10. An automotive headlight as defined in claim 1 wherein said securing tabs are distributed irregularly around said retaining ring.

11. An automotivve headlight as defined in claim 1 including a flange on said lamp; spring-loaded arms pressing against said flange, said arms being cut free from an inner edge of said retaining ring between said reflector and said retaining ring.

* * * * *